US011952994B2

(12) United States Patent
Fujisaki

(10) Patent No.: US 11,952,994 B2
(45) Date of Patent: Apr. 9, 2024

(54) PIEZOELECTRIC PUMP HOUSING AND TERMINAL ARRANGEMENT

(71) Applicant: Murata Manufacturing Co., Ltd., Kyoto (JP)

(72) Inventor: Masaaki Fujisaki, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 244 days.

(21) Appl. No.: 16/906,110

(22) Filed: Jun. 19, 2020

(65) Prior Publication Data

US 2020/0318629 A1 Oct. 8, 2020

Related U.S. Application Data

(63) Continuation of application No. PCT/JP2018/044347, filed on Dec. 3, 2018.

(30) Foreign Application Priority Data

Dec. 22, 2017 (JP) ..... 2017-247009

(51) Int. Cl.
*F04B 43/04* (2006.01)
*F04B 45/047* (2006.01)

(52) U.S. Cl.
CPC ..... *F04B 43/046* (2013.01); *F04B 45/047* (2013.01)

(58) Field of Classification Search
CPC ..... F04B 45/047; F04B 43/04; F04B 43/046
See application file for complete search history.

(56) References Cited

U.S. PATENT DOCUMENTS

| | | | | |
|---|---|---|---|---|
| 8,596,998 | B2 * | 12/2013 | Fujisaki | F04B 45/047 92/96 |
| 9,406,861 | B2 * | 8/2016 | Ukai | H01L 41/083 |
| 10,107,281 | B2 * | 10/2018 | Tanaka | F04B 53/08 |
| 10,388,850 | B2 * | 8/2019 | Chen | F04B 45/047 |
| 10,920,765 | B2 * | 2/2021 | Fujisaki | F04B 45/047 |

(Continued)

FOREIGN PATENT DOCUMENTS

| | | | |
|---|---|---|---|
| CN | 106030108 | A | 10/2016 |
| JP | 2000-287468 | A | 10/2000 |

(Continued)

OTHER PUBLICATIONS

English Machine Translation of JP2000287468A (Year: 2000).*

(Continued)

*Primary Examiner* — Nathan C Zollinger
(74) *Attorney, Agent, or Firm* — Pearne & Gordon LLP

(57) ABSTRACT

A pump includes a pump housing, a vibrating plate, a driving element, and a power-feeding plate including a first conductive portion and a second conductive portion electrically insulated from the first conductive portion. The driving element has a first surface and a second surface. The first conductive portion includes a first outer terminal part, a first connecting terminal part electrically connected to the second surface of the driving element, and a first coupling part coupling the first outer terminal part and the first connecting terminal part to each other. The second conductive portion includes a second outer terminal part and a second connecting terminal part electrically connected to the second outer terminal part and to the first surface of the driving element.

20 Claims, 9 Drawing Sheets

(56) References Cited

U.S. PATENT DOCUMENTS

| | | | | |
|---|---|---|---|---|
| 2007/0138914 | A1* | 6/2007 | Ishikawa | H10N 30/875 310/328 |
| 2010/0068080 | A1 | 3/2010 | Meng et al. | |
| 2013/0058809 | A1* | 3/2013 | Hirata | F04B 43/043 417/413.2 |
| 2017/0058882 | A1 | 3/2017 | Hirata et al. | |
| 2018/0066650 | A1 | 3/2018 | Fujisaki et al. | |
| 2020/0318630 | A1* | 10/2020 | Kondo | F04B 45/10 |

FOREIGN PATENT DOCUMENTS

| | | | | |
|---|---|---|---|---|
| JP | 2000287468 | A | * 10/2000 | |
| JP | 2007307572 | A | * 11/2007 | |
| JP | 2012026274 | A | 2/2012 | |
| JP | 2013147965 | A | 8/2013 | |
| WO | WO-2012117831 | A1 * | 9/2012 | F04B 43/046 |
| WO | 2016175185 | A1 | 11/2016 | |

OTHER PUBLICATIONS

English Machine Translation of Description of JP2007307572A (Year: 2007).*

Chinese Office action for Application No. 201880082980.0 dated Jul. 5, 2021.

International Search Report for International Application No. PCT/JP2018/044347, dated Feb. 26, 2019.

Written Opinion for International Application No. PCT/JP2018/044347, dated Feb. 26, 2019.

* cited by examiner

PIEZOELECTRIC PUMP HOUSING AND TERMINAL ARRANGEMENT

This is a continuation of International Application No. PCT/JP2018/044347 filed on Dec. 3, 2018 which claims priority from Japanese Patent Application No. 2017-247009 filed on Dec. 22, 2017. The contents of these applications are incorporated herein by reference in their entireties.

BACKGROUND

Technical Field

The present disclosure relates to displacement pumps utilizing bending vibration of vibrating plates and particularly to a piezoelectric pump utilizing a piezoelectric device as a driving element that drives a vibrating plate.

Piezoelectric pumps are a kind of hitherto known displacement pump. A piezoelectric pump has a pump chamber at least part of which is defined by a vibrating plate to which a piezoelectric device is bonded. When an alternating voltage at a predetermined frequency is applied to the piezoelectric device, the vibrating plate is driven at a resonant frequency. Thus, the pressure in the pump chamber is changed such that a fluid can be suctioned and discharged.

Such piezoelectric pumps are disclosed by, for example, Japanese Unexamined Patent Application Publication No. 2013-147965 (Patent Document 1) and International Publication No. 2016/175185 (Patent Document 2).

In a piezoelectric pump disclosed by Patent Document 1, a piezoelectric device bonded to a vibrating plate is formed of a stack of a plurality of piezoelectric layers and includes a central portion that expands and contracts in accordance with the voltage applied, a peripheral portion positioned on the outer side than the central portion and that expands and contracts in a phase inverted from that of the central portion in accordance with the voltage applied, and an outer portion positioned on the outer side than the peripheral portion and that is inactive.

In a piezoelectric pump disclosed by Patent Document 2, a counter plate having a first outer terminal part, a vibrating plate to which a piezoelectric device is bonded, an insulating plate surrounding the piezoelectric device, and a power-feeding plate having a second outer terminal part and a connecting terminal that is to be connected to an upper surface of the piezoelectric device are stacked in that order from the lower side.

Patent Document 1: Japanese Unexamined Patent Application Publication No. 2013-147965

Patent Document 2: International Publication No. 2016/175185

BRIEF SUMMARY

According to Patent Document 1, the plurality of piezoelectric layers need to be connected by via connection or the like at desired positions. Furthermore, since the plurality of piezoelectric layers need to be stacked, the piezoelectric device has a complicated configuration.

In the piezoelectric pump disclosed by Patent Document 2, the power-feeding plate having the first outer terminal part is positioned on the upper side of the vibrating plate to which the piezoelectric device is bonded, and the power-feeding plate having the second outer terminal part is positioned on the lower side of the vibrating plate. The piezoelectric device is driven when a current is made to flow therethrough in the thickness direction. Such a configuration of the piezoelectric device is simple.

However, there is a certain level difference between the first outer terminal part and the second outer terminal part. Therefore, when the piezoelectric pump disclosed by Patent Document 2 is mounted on a circuit board or the like, there may be a difficulty in connecting the first outer terminal part and the second outer terminal part to respective terminal parts of the circuit board. Since the first outer terminal part and the second outer terminal part are positioned at different levels, if, for example, lead wires are used in connecting the terminal parts of the circuit board to the first outer terminal part and the second outer terminal part, vibration generated by driving the piezoelectric pump may be transmitted to the lead wires, which may generate noise.

The present disclosure has been conceived in view of the above problems and to provide a pump that is easy to mount.

A pump according to the present disclosure includes a pump housing having a pump chamber; a vibrating plate having a first major surface and facing the pump chamber; a driving element provided on the first major surface and vibrating the vibrating plate; and a power-feeding plate including a first conductive portion a part of which is exposed to an outside from the pump housing, and a second conductive portion electrically insulated from the first conductive portion. The driving element has a first surface facing the first major surface, and a second surface positioned on a side farther from the first major surface. The first conductive portion includes a first outer terminal part positioned outside the pump housing, a first connecting terminal part electrically connected to the second surface of the driving element, and a first coupling part coupling the first outer terminal part and the first connecting terminal part to each other. The second conductive portion includes a second outer terminal part positioned outside the pump housing, and a second connecting terminal part electrically connected to the second outer terminal part and to the first surface of the driving element.

In the pump according to the present disclosure, the power-feeding plate may include a holding portion holding both the first conductive portion and the second conductive portion.

In the pump according to the present disclosure, the second conductive portion may include a second coupling part coupling the second outer terminal part and the second connecting terminal part to each other, and the first coupling part and the second coupling part may each include a portion extending along an outer periphery of the holding portion.

In the pump according to the present disclosure, the portion of each of the first coupling part and the second coupling part that extends along the outer periphery of the holding portion may include an extruded part extruded outward from the holding portion.

In the pump according to the present disclosure, the holding portion can have an opening extending through the holding portion in a thickness direction such that the driving element is exposed. In such a case, the first connecting terminal part may include a meandering part meandering from an inner peripheral surface of the holding portion into the opening, the inner peripheral surface defining the opening.

In the pump according to the present disclosure, the holding portion may be a cured resin member. In such a case, the first coupling part and the second coupling part each can have a through-hole in a region overlapping the holding portion in plan view, and the cured resin member can be provided over front and back surfaces of the region overlapping the holding portion and fill the through-hole.

In the pump according to the present disclosure, the second conductive portion can include an exposed part and be electrically continuous with the first major surface of the vibrating plate by being in contact with the first major surface.

In the pump according to the present disclosure, the power-feeding plate can include a holding portion holding both the first conductive portion and the second conductive portion, and that the exposed part be surrounded by the holding portion in plan view.

In the pump according to the present disclosure, the exposed part may be one of a plurality of exposed parts.

In the pump according to the present disclosure, the first outer terminal part and the second outer terminal part can be provided in one plane.

In the pump according to the present disclosure, a reinforcing plate provided on the power-feeding plate on a side farther from the vibrating plate may further be included.

The pump according to the present disclosure may further include a reinforcing plate provided on the power-feeding plate on a side farther from the vibrating plate, and the power-feeding plate may include a holding portion holding both the first conductive portion and the second conductive portion. In such a case, a difference in a coefficient of linear expansion between the reinforcing plate and the holding portion can be substantially equal to a difference in a coefficient of linear expansion between the vibrating plate and the holding portion.

According to the present disclosure, a pump that is easy to mount can be provided.

DETAILED DESCRIPTION

Figure 1:
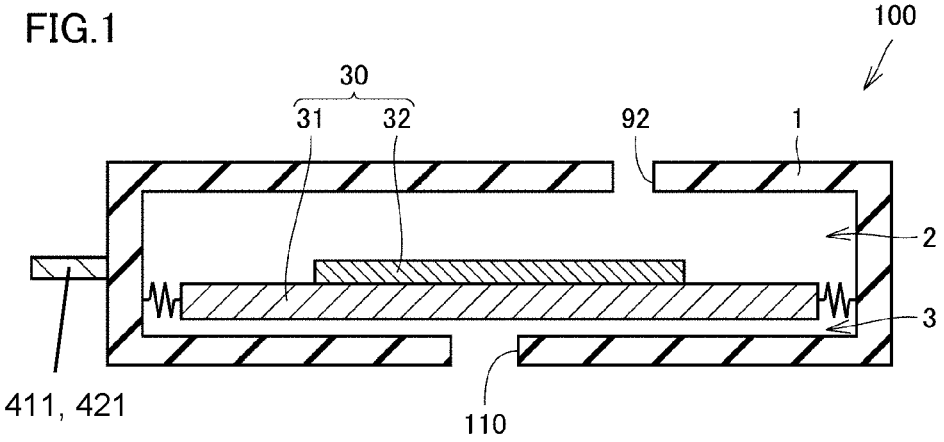
FIG. 1 is a schematic sectional view of a piezoelectric blower according to a first embodiment.

Embodiments of the present disclosure will now be described in detail with reference to the drawings. The following embodiments each exemplify a case where the present disclosure is applied to a piezoelectric blower as a pump that suctions and discharges gas. In the following embodiments, the same or common elements are denoted by the same reference numerals used in the drawings, and redundant description of such elements is omitted.

First Embodiment (Piezoelectric Blower)

Figure 2:
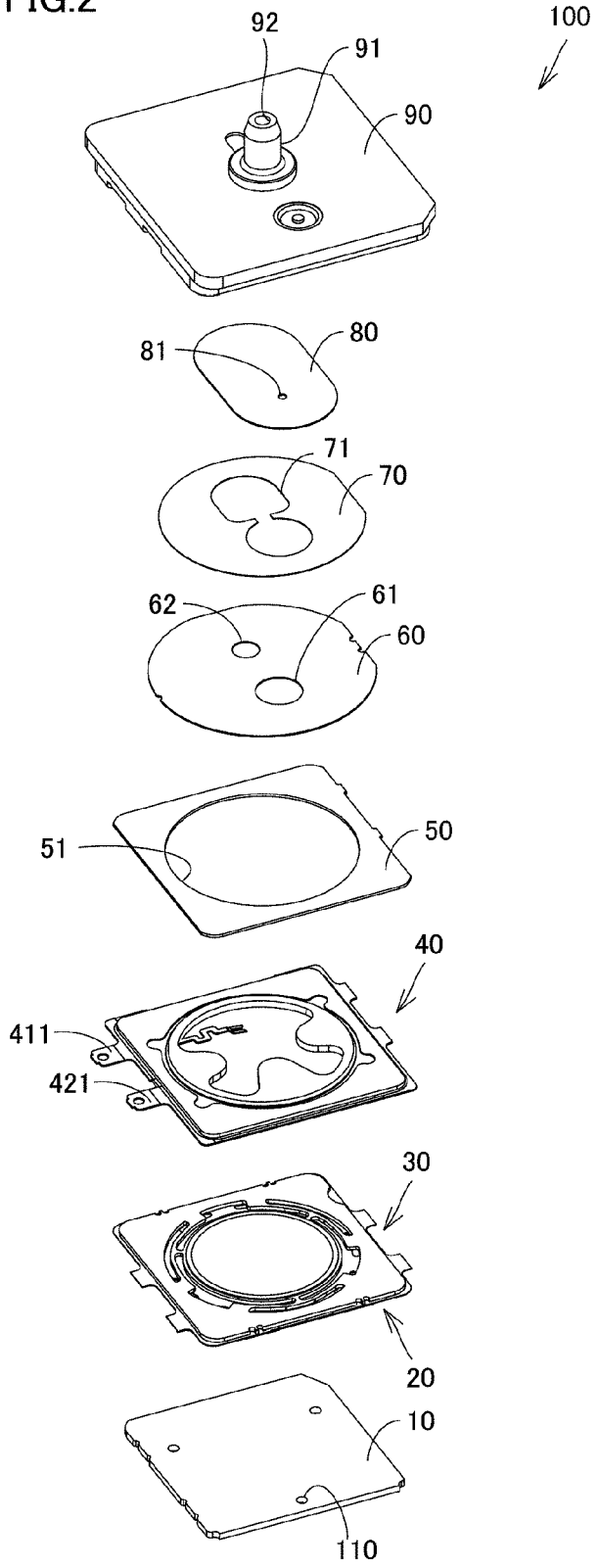
FIG. 2 is an exploded perspective view of the piezoelectric blower according to the first embodiment.

FIG. 1 is a schematic sectional view of a piezoelectric blower according to a first embodiment. FIG. 2 is an exploded perspective view of the piezoelectric blower according to the first embodiment. Referring to FIGS. 1 and 2, a piezoelectric blower 100 according to the first embodiment will now be described.

As illustrated in FIG. 1, the piezoelectric blower 100 according to the first embodiment includes a pump housing 1 and a vibrating unit 30. The pump housing 1 has thereinside a pump chamber 2 and a passage portion 3. Furthermore, the pump housing 1 has suction holes 110 and an exhaust hole 92. The suction holes 110 are continuous with the passage portion 3. The exhaust hole 92 is continuous with the pump chamber 2.

The vibrating unit 30 includes a vibrating plate 31 and a piezoelectric device 32 as a driving element. The vibrating plate 31 faces the pump chamber 2. The piezoelectric device 32 is bonded to the vibrating plate 31. The piezoelectric device 32 vibrates the vibrating plate 31.

When a driving voltage is applied to the piezoelectric device 32, the vibrating plate 31 vibrates. Thus, the pressure in the pump chamber 2 changes. Hence, gas suctioned from the suction holes 110 flows through the passage portion 3 and the pump chamber 2 in that order and is exhausted from the exhaust hole 92.

(Details of Piezoelectric Blower)

As illustrated in FIG. 2, the piezoelectric blower 100 includes a cover plate 10, a passage-defining portion 20, the vibrating unit 30, a power-feeding plate 40, a reinforcing plate 50, a second reinforcing plate 60, a joining member 70, a diaphragm 80, and a valve housing 90 that are stacked in that order. A combination of the cover plate 10, the passage-defining portion 20, the vibrating unit 30, the power-feeding plate 40, the reinforcing plate 50, and the outer wall portion of the valve housing 90 forms the pump housing 1.

In the following description, a direction heading from the cover plate 10 toward the valve housing 90 is defined as upward direction, and a direction heading from the valve housing 90 toward the cover plate 10 is defined as downward direction.

The cover plate 10 has a plate shape. The cover plate 10 has three suction holes 110. The three suction holes 110 are arranged at intervals in the circumferential direction. The three suction holes 110 are at substantially regular intervals.

Figure 3:
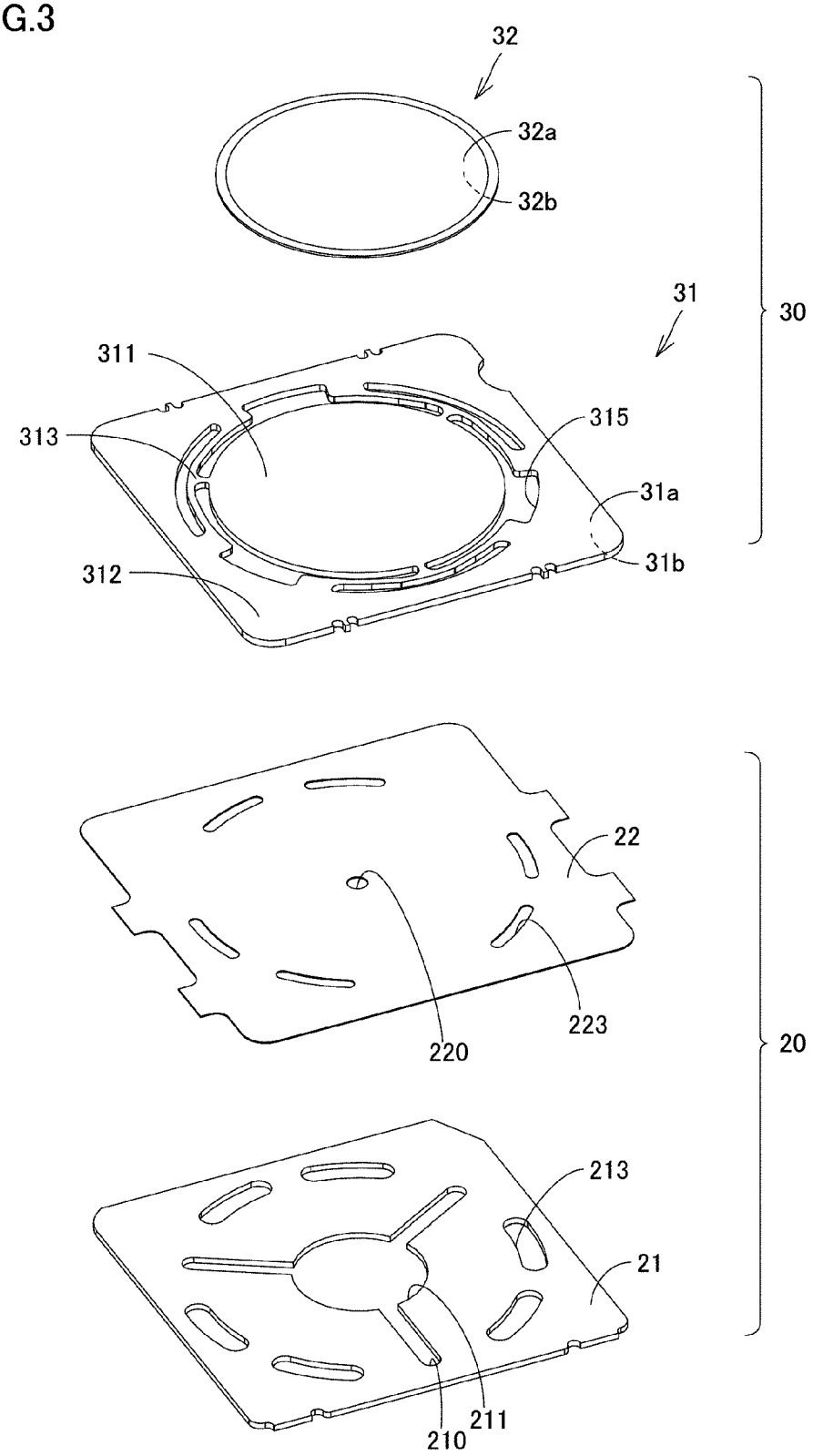
FIG. 3 is an exploded perspective view of a vibrating unit and a passage-defining portion according to the first embodiment.

FIG. 3 is an exploded perspective view of the passage-defining portion and the vibrating unit according to the first embodiment. Referring to FIGS. 2 and 3, the passage-defining portion 20 and the vibrating unit 30 will now be described.

As illustrated in FIGS. 2 and 3, the passage-defining portion 20 defines the passage portion 3 extending from the suction holes 110 to the pump chamber 2. The passage-defining portion 20 includes a first passage-defining member 21 and a second passage-defining member 22.

The first passage-defining member 21 has a passage hole 211, three passage holes 210, and six adhesive-confining holes 213. The passage hole 211 has a circular shape and is provided in a central portion of the first passage-defining member 21. The three passage holes 210 extend radially from the passage hole 211.

The six adhesive-confining holes 213 are arranged at intervals in the circumferential direction. The six adhesive-confining holes 213, each extends in the circumferential direction in such a manner as to face respective positions of the below-described vibrating plate 31 where a frame portion 312 is connected to connecting portions 313. The adhesive-confining holes 213 are covered by the cover plate 10 at the lower ends thereof and are continuous with adhesive-confining holes 223, respectively, at the upper ends thereof. The adhesive-confining holes 223 are provided in the second passage-defining member 22 to be described below.

The second passage-defining member 22 has one passage hole 220 and six adhesive-confining holes 223. The passage hole 220 is provided in a central portion of the second passage-defining member 22 and has a circular shape with a smaller diameter than the passage hole 211 of the first passage-defining member 21. The passage hole 220 overlaps the passage hole 211 in the vertical direction and is continuous with the passage hole 211.

The six adhesive-confining holes 223 are arranged at intervals in the circumferential direction. The six adhesive-confining holes 223, each extends in the circumferential direction in such a manner as to face respective positions of the vibrating plate 31 where the frame portion 312 is connected to the connecting portions 313. The adhesive-confining holes 223 are continuous with the adhesive-confining holes 213, respectively, of the first passage-defining member 21 at the lower ends thereof and face an adhesive layer (not illustrated) at the upper ends thereof.

The adhesive-confining holes 213 and 223 prevent the adhesive layer, when yet to be cured, from flowing into the pump chamber 2 and adhering to the connecting portions 313 of the vibrating plate 31. Therefore, the connecting portions 313 are not hindered from vibrating. Consequently, the occurrence of variations in characteristics among finished products can be prevented.

The distal ends of the passage holes 210 provided in the first passage-defining member 21 are continuous with the suction holes 110, respectively. The passage holes 210, excluding the distal ends that are continuous with the suction holes 110, are covered by the cover plate 10 from the lower side thereof and by the second passage-defining member 22 from the upper side thereof. Therefore, the gas suctioned from the suction holes 110 flows through the passage holes 210 toward the passage hole 211.

The passage hole 211 is continuous with the passage hole 220 provided in the second passage-defining member 22. Therefore, the gas having flowed into the passage hole 211 flows toward the passage hole 220.

The second passage-defining member 22 is positioned at some distance from the vibrating plate 31, to be described below, in the vertical direction. Hence, the passage hole 220 communicates with the pump chamber 2 through the gap between the vibrating plate 31 and the second passage-defining member 22 and through hole portions 315 provided in the vibrating plate 31 to be described below. Therefore, the gas having flowed into the passage hole 220 flows through the gap and the hole portions 315 into the pump chamber 2. Thus, the combination of the first passage-defining member 21 and the second passage-defining member 22 defines the passage extending from the suction holes 110 to the pump chamber 2.

As described above, the vibrating unit 30 includes the vibrating plate 31 and the piezoelectric device 32. The vibrating plate 31 is, for example, a metal thin plate made of stainless steel or the like. The vibrating plate 31 has a substantially rectangular contour. The vibrating plate 31 has a first major surface (upper surface) 31*a* and a second major surface (lower surface) 31*b* that are opposite each other.

The vibrating plate 31 includes a disc portion 311, the frame portion 312, and three connecting portions 313. The vibrating plate 31 has a plurality of hole portions 315 each surrounded by the disc portion 311, the frame portion 312, and corresponding ones of the connecting portions 313. The frame portion 312 surrounds the disc portion 311 while being spaced apart from the disc portion 311.

The connecting portions 313 connect the disc portion 311 and the frame portion 312 to each other. The connecting portions 313, each generally has a T shape and is arranged at intervals in the circumferential direction. Specifically, the connecting portions 313 are each connected to the disc portion 311 at an end thereof nearer to the center of the vibrating plate 31. The connecting portion 313 extends in the radial direction from the disc portion 311 and then splits into two segments each extending in the circumferential direction. Then, the two segments of the connecting portion 313 extending in the circumferential direction each bends toward the frame portion 312 and are each connected to the frame portion 312.

Since the connecting portions 313 are shaped as above, the disc portion 311 is supported at the edge thereof by the frame portion 312 in such a manner as to be displaceable in the vertical direction (the thickness direction) but hardly displaceable in the horizontal direction.

The piezoelectric device 32 is made of a piezoelectric material such as lead zirconate titanate (PZT) or the like. The piezoelectric device 32 has a disc shape and has a first surface 32*b* facing the first major surface 31*a*, and a second surface 32*a* positioned on a side farther from the first major surface 31*a*.

The piezoelectric device 32 is bonded to the first major surface 31*a* of the vibrating plate 31 with conductive adhesive or the like. More specifically, the piezoelectric device 32 is bonded to a portion of the first major surface 31*a* that forms the disc portion 311.

When an alternating voltage is applied to the piezoelectric device 32, the piezoelectric device 32 undergoes bending vibration. The bending vibration undergone by the piezoelectric device 32 is transmitted to the vibrating plate 31. Consequently, the vibrating plate 31 undergoes bending vibration. Thus, the pressure in the pump chamber 2 changes.

Referring to FIG. 2 again, the power-feeding plate 40 faces the first major surface 31*a* of the vibrating plate 31 in such a manner as to surround the piezoelectric device 32. The power-feeding plate 40 includes, as to be described below, a first outer terminal part 411 and a second outer terminal part 421 that are positioned outside the pump housing 1.

As to be described below, the first outer terminal part 411 is electrically connected to the second surface 32*a* of the piezoelectric device 32, while the second outer terminal part 421 is electrically connected to the first surface 32*b* of the piezoelectric device 32. Therefore, when a voltage is applied between the first outer terminal part 411 and the second outer terminal part 421, the voltage is applied to the piezoelectric device 32. Details of the power-feeding plate 40 will be described separately below with reference to FIGS. 4 to 6.

The reinforcing plate 50 has a frame shape with, in plan view, a circular hole portion 51 provided therein. The reinforcing plate 50 is provided on the power-feeding plate 40 on a side farther from the vibrating plate 31. The reinforcing plate 50 is provided on the power-feeding plate 40 in such a manner as to surround an inner frame part 432 (see FIG. 4) of the power-feeding plate 40 to be described below. The reinforcing plate 50 is made of, for example, a metal material. With the reinforcing plate 50, the rigidity of the pump housing is ensured.

The reinforcing plate 50 can be made of a material substantially the same as the material of the vibrating plate 31. Specifically, a difference $d_1$ between a coefficient of linear expansion $\alpha_r$, of the reinforcing plate 50 and a coefficient of linear expansion $\alpha_h$ of a holding portion 43 of the power-feeding plate 40 to be described below can be substantially the same as a difference $d_2$ between a coefficient of linear expansion $\alpha_v$ of the vibrating plate 31 and the coefficient of linear expansion $\alpha_h$ of the holding portion 43. That is, $d_1$ an be substantially the same as $d_2$. If such a relationship is established, warping of the power-feeding plate 40 due to temperature difference can be suppressed.

The second reinforcing plate 60 covers the hole portion 51 of the reinforcing plate 50. The second reinforcing plate 60 has a first hole portion 61 and a second hole portion 62 that are continuous with the hole portion 51. The joining member 70 joins the second reinforcing plate 60 and the diaphragm 80 to each other. The joining member 70 has a hole portion 71 continuous with the first hole portion 61 and with the second hole portion 62.

The diaphragm 80 has a hole portion 81 continuous with the hole portion 71. The hole portion 81 is continuous with the exhaust hole 92 of the nozzle portion 91 included in the valve housing 90.

An opening 434 (see FIG. 4) of the power-feeding plate 40 to be described below, the hole portion 51, the first hole portion 61, the second hole portion 62, the hole portion 71, the hole portion 81, and the exhaust hole 92 are continuous with one another, whereby the pump chamber 2 is provided. The gas having entered the opening 434 flows through the above hole portions and is exhausted from the exhaust hole 92.

(Details of Power-Feeding Plate)

Figure 4:
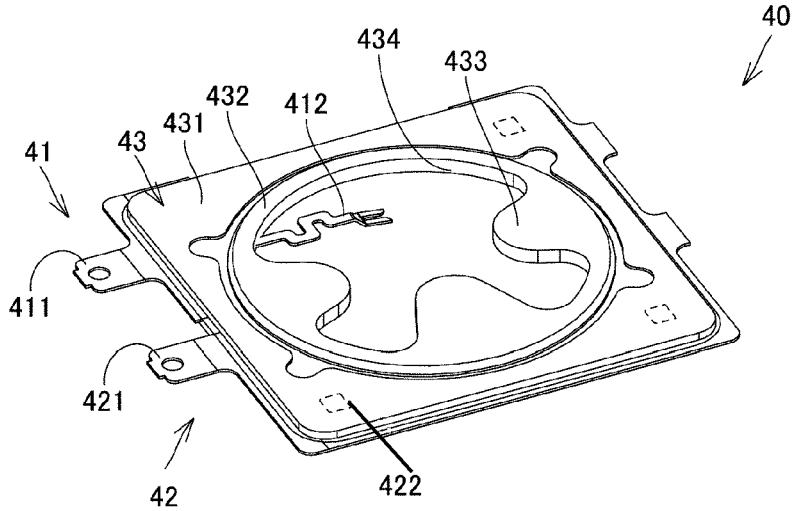
FIG. 4 is a perspective view of a power-feeding plate illustrated in FIG. 2, seen from a side farther from the vibrating plate.
Figure 5:
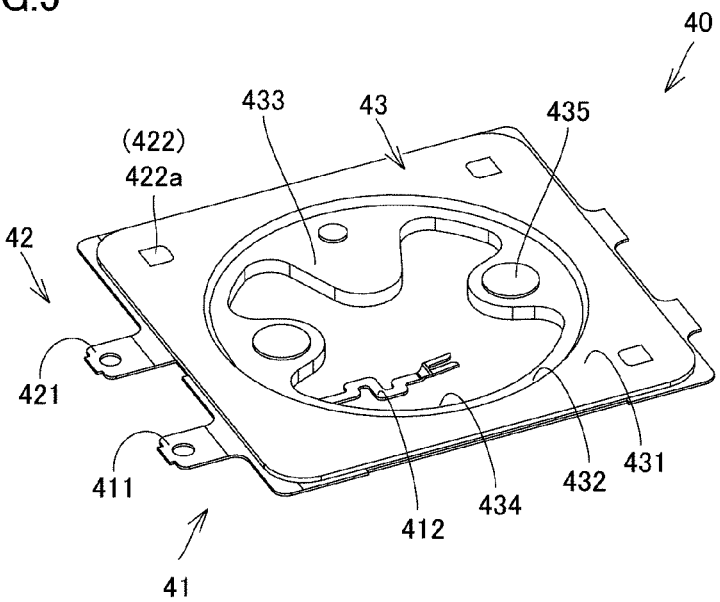
FIG. 5 is a perspective view of the power-feeding plate illustrated in FIG. 2, seen from a side nearer to the vibrating plate.
Figure 6:
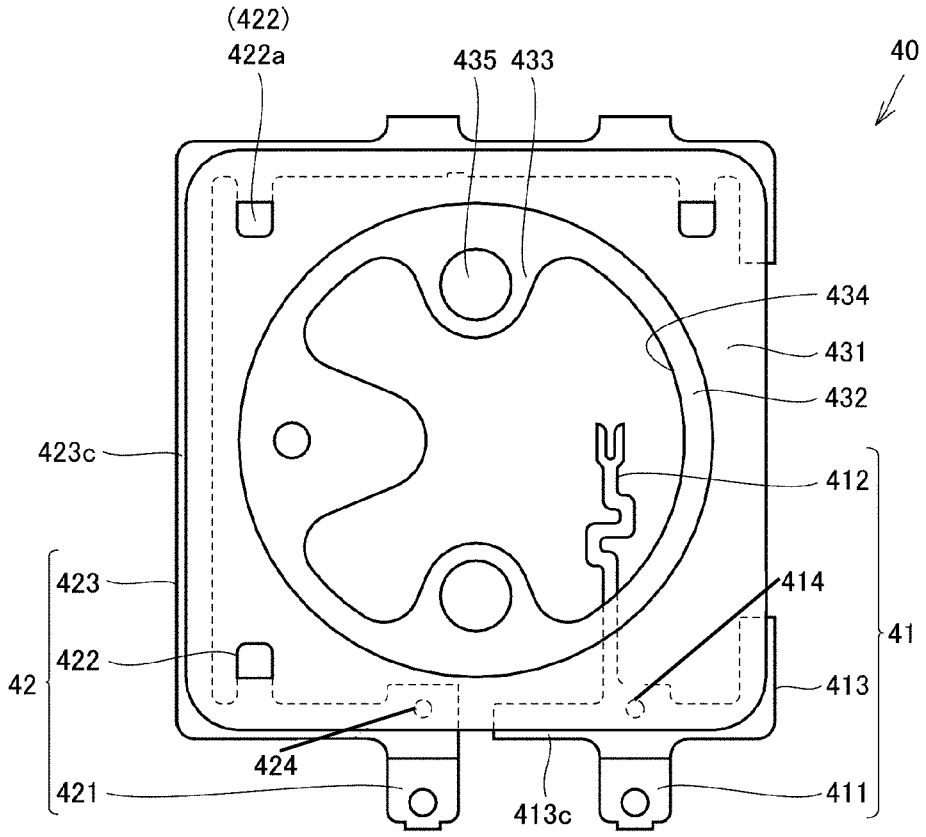
FIG. 6 is a plan view of the power-feeding plate according to the first embodiment, seen from the side nearer to the vibrating plate.

FIG. 4 is a perspective view of the power-feeding plate illustrated in FIG. 2, seen from a side farther from the vibrating plate. FIG. 5 is a perspective view of the power-feeding plate illustrated in FIG. 2, seen from a side nearer to the vibrating plate. FIG. 6 is a plan view of the power-feeding plate according to the first embodiment, seen from the side nearer to the vibrating plate. Referring to FIGS. 4 to 6, details of the power-feeding plate 40 will now be described.

As illustrated in FIGS. 4 to 6, the power-feeding plate 40 includes a first conductive member 41 as a first conductive portion, a second conductive member 42 as a second conductive portion, and the holding portion 43.

The first conductive member 41 and the second conductive member 42, each includes a portion projecting from the pump housing to the outside. That is, the first conductive member 41 and the second conductive member 42 each include a portion exposed to the outside of the pump housing. The first conductive member 41 and the second conductive member 42 are spaced apart from each other. The first conductive member 41 and the second conductive member 42 are electrically insulated from each other. The first conductive member 41 and the second conductive member 42 are each, for example, a metal strip containing copper. While the first conductive member 41 and the second conductive member 42 exemplified herein are separate from each other, the first conductive member 41 and the second conductive member 42 are not limited thereto and may be integrated into a unit, as long as they are electrically insulated from each other.

The first conductive member 41 includes a first outer terminal part 411, a first connecting terminal part 412, and a first coupling part 413. The first outer terminal part 411 is positioned outside the pump housing 1. The first outer terminal part 411 is provided at the distal end of the portion of the first conductive member 41 that projects outward from the pump housing 1.

The first outer terminal part 411 can have a treated surface. For example, the first outer terminal part 411 can be coated with a Sn-plate layer. In such a case, the first outer terminal part 411 can be soldered, as to be described below, with good adherence. In addition, the plate layer as a treated-surface portion can be out of contact with the holding portion 43. In such a case, the solder used in the soldering process can be prevented from coming into contact with the holding portion 43.

The first connecting terminal part 412 is electrically connected to the second surface 32*a* of the piezoelectric device 32. Specifically, the distal end of the first connecting terminal part 412 is soldered to the second surface 32*a* of the piezoelectric device 32. The first connecting terminal part 412 can have a treated surface. For example, the first connecting terminal part 412 can be coated with a Sn-plate layer. In such a case, soldering can be performed with good adherence.

The inner peripheral surface of the holding portion 43, to be described below, defines the opening 434. The first connecting terminal part 412 extends from the inner peripheral surface of the holding portion 43 into the opening 434. The first connecting terminal part 412 includes a meandering portion meandering into the opening 434. Therefore, the first connecting terminal part 412 can be made longer than in a case where the connecting terminal part has a linear shape.

Since the first connecting terminal part 412 has an increased length, the vibration occurring at a distal portion of the first connecting terminal part 412 with the displacement of the piezoelectric device 32 can be reduced. The vibration is transmitted to a proximal portion of the first connecting terminal part 412. Consequently, the load to be applied to the proximal portion of the first connecting terminal part 412 can be reduced, and the breakage at the proximal portion of the first connecting terminal part 412 can be suppressed.

The first coupling part 413 couples the first outer terminal part 411 and the first connecting terminal part 412 to each other. The first coupling part 413 includes a portion extending along the outer periphery of the holding portion 43. The first coupling part 413 extends along, in plan view, one of the four corners of the holding portion 43. The first coupling part 413 has a substantially L shape.

The portion of the first coupling part 413 that extends along the outer periphery of the holding portion 43 includes an extruded part 413*c* extruded outward from the holding portion 43. The first coupling part 413 has a through-hole 414 in a region thereof overlapping the holding portion in plan view.

The second conductive member 42 includes a second outer terminal part 421, second connecting terminal parts 422, and a second coupling part 423. The second outer terminal part 421 is positioned outside the pump housing 1. The second outer terminal part 421 is provided at the distal end of a portion of the second conductive member 42 that projects outward from the pump housing.

The second outer terminal part 421 can have a treated surface. For example, the second outer terminal part 421 can be coated with a Sn-plate layer. In such a case, the second outer terminal part 421 can be soldered, as to be described below, with good adherence. In addition, the plate layer as a treated-surface portion can be out of contact with the holding portion 43. In such a case, the solder used in the soldering process can be prevented from coming into contact with the holding portion 43.

The second connecting terminal parts 422 are electrically connected to the second outer terminal part 421 and to the first surface 32*b* of the piezoelectric device 32 described above. The second connecting terminal parts 422, each includes an exposed part 422*a*. The exposed part 422*a* is positioned inside the pump housing and is exposed from the holding portion 43 in such a manner as to face the first major surface 31*a* of the vibrating plate 31. There are provided a plurality of exposed parts 422*a*. Specifically, three exposed parts 422*a* are provided. The three exposed parts 422*a* are provided on the inner side, in plan view, of three of the four corners of the holding portion 43 where the first coupling part 413 described above is absent.

The exposed parts 422*a* are in contact with the first major surface 31*a* of the vibrating plate 31. Therefore, the second conductive member 42 is electrically connected to the first surface 32*b* of the piezoelectric device 32 through the vibrating plate 31. That is, since the exposed parts 422*a* are in contact with the first major surface 32*b* and thus are electrically continuous therewith, conduction paths that allow the exposed parts 422*a* to be electrically connected to the first surface 32*b* of the piezoelectric device 32 are provided in the vibrating plate 31.

Since there are the plurality of exposed parts 422*a*, more assured contact can be achieved between the vibrating plate 31 and the exposed parts 422*a*.

The exposed parts 422*a* are each surrounded by the holding portion 43 in plan view (viewed in a direction perpendicular to the main surface of the power-feeding plate). Thus, the exposed parts 422*a* can be prevented from projecting into the opening 434 of the holding portion 43. If the exposed parts 422*a* should project into the opening 434, a force generated by the movement of the gas in the pump chamber 7 may act on the exposed parts 422*a* and peel the exposed parts 422*a*. In the present embodiment, the exposed parts 422*a* do not project into the opening 434. Therefore, peeling of the exposed parts 422*a* can be suppressed.

The exposed parts 422*a*, each has a treated surface. For example, the exposed parts 422*a* are each coated with a Sn-plate layer. Thus, rusting of the exposed parts 422*a* can be suppressed.

The second coupling part 423 couples the second outer terminal part 421 to the plurality of exposed parts 422*a*. The second coupling part 423 includes a portion extending along the outer periphery of the holding portion 43. Specifically, the second coupling part 423 includes a portion extending along, in plan view, the outer periphery of the holding portion 43 in such a manner as to sequentially pass along the three of the four corners of the holding portion 43 where the first coupling part 413 described above is absent.

The portion of the second coupling part 423 that extends along the outer periphery of the holding portion 43 includes an extruded part 423*c* extruded outward from the holding portion 43. The second coupling part 423 has a through-hole 424 in a region thereof overlapping the holding portion in plan view (viewed in a direction perpendicular to a main surface of the power-feeding plate 40).

The holding portion 43 holds both the first conductive member 41 and the second conductive member 42. The holding portion 43 is a cured resin member. The resin member has an insulating characteristic. The holding portion 43 is molded such that the first conductive member 41 and the second conductive member 42 are exposed in part thereof.

As described above, the first coupling part 413 and the second coupling part 423, each includes the extruded part extending along the outer periphery of the holding portion 43 and extruded outward from the holding portion 43. Therefore, if the first conductive member 41, the second conductive member 42, and the holding portion 43 are formed together as a single unit by injection molding, the extruded parts can be supported on the outside of the mold.

In such a method, there is no need to prepare a structure for pressing the first conductive member 41 and the second conductive member 42 in the mold. Therefore, the plan-view area of the holding portion 43 can be increased. Thus, the holding portion 43 can be joined to the vibrating plate stably and with an increased joining area.

The first coupling part 413 and the second coupling part 423 include the respective through-holes 414 and 424 in the regions thereof overlapping the holding portion 43 in plan view. The above-mentioned cured resin member is provided over the front and back surfaces of the regions overlapping the holding portion 43 and fills the through-holes 414 and 424. Therefore, the first conductive member 41 and the second conductive member 42 can be prevented from dropping from the holding portion 43.

The holding portion 43 includes an outer frame part 431, an inner frame part 432, and displacement-regulating parts 435. The outer frame part 431 has a substantially rectangular shape in plan view. The outer frame part 431 surrounds the inner frame part 432 and defines the contour of the holding portion 43.

The inner frame part 432 has a substantially circular contour in plan view. The inner frame part 432 has the opening 434 extending therethrough in the thickness direction (in a direction perpendicular to the main surface of the power-feeding plate 40) such that the piezoelectric device 32 is exposed. The inner peripheral surface of the inner frame part 432 that defines the opening 434 defines part of the pump chamber 2.

The inner frame part 432 and the outer frame part 431 are positioned at different levels. The inner frame part 432 is positioned at a higher level than the outer frame part 431. The upper surface of the inner frame part 432 is at a higher level than the upper surface of the outer frame part 431, and the lower surface of the inner frame part 432 is at a higher level than the lower surface of the outer frame part 431.

If the second surface 32*a* of the piezoelectric device 32 is positioned too close to the lower surface of the inner frame part 432, the amplitude of vibration is reduced because of air resistance. Therefore, in the first embodiment, the lower surface of the inner frame part 432 is positioned away from the piezoelectric device 32.

The inner frame part 432 includes three wave parts 433 each projecting into the opening 434. The wave parts 433 are continuous with one another in plan view, thereby forming a series of waves. The three wave parts 433 are respectively provided in three of four areas of the inner frame part 432 that are divided in the circumferential direction.

The displacement-regulating parts 435 are provided on the lower surfaces of the respective wave parts 433 that face toward the piezoelectric device 32. The displacement-regulating parts 435, each has a circular shape in plan view and project toward the piezoelectric device 32. When an impact load or the like is applied, the displacement-regulating parts 435 come into contact with the second surface 32*a* of the piezoelectric device 32, thereby suppressing excessive stretching of the connecting portions 313 of the vibrating plate 31. The displacement-regulating parts 435 are provided in such a manner as not to hinder the bending vibration of the piezoelectric device 32.

Figure 7:
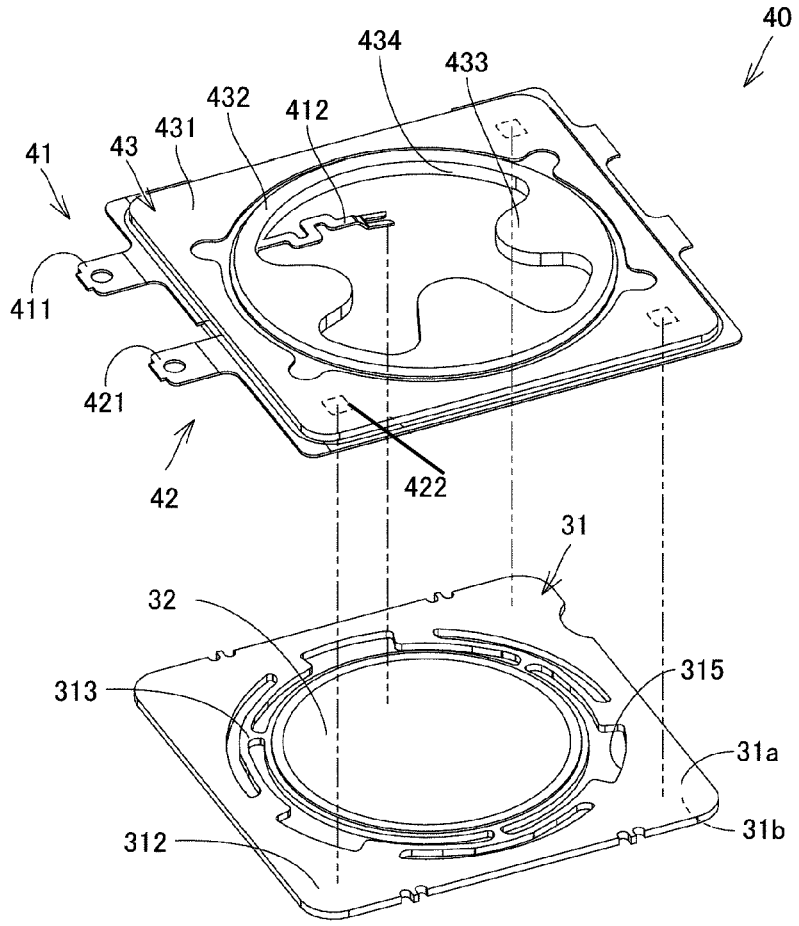
FIG. 7 is a diagram illustrating electrical connection between the power-feeding plate and the vibrating unit according to the first embodiment.

FIG. 7 is a diagram illustrating electrical connection between the power-feeding plate and the vibrating unit according to the first embodiment. Referring to FIG. 7, electrical connection between the power-feeding plate 40 and the vibrating unit 30 will now be described.

As illustrated in FIG. 7, the first connecting terminal part 412 electrically connected to the first outer terminal part 411 is electrically connected to the second surface 32*a* of the piezoelectric device 32. The exposed parts 422*a* electrically connected to the second outer terminal part 421 are in contact with the first major surface 31*a* of the vibrating plate 31 and are thus electrically connected to the first surface 32*b* of the piezoelectric device 32 through the vibrating plate 31. Hence, when a voltage is applied to the first outer terminal part 411 and the second outer terminal part 421, the voltage is applied to the piezoelectric device 32.

(Mounted State)

Figure 8:
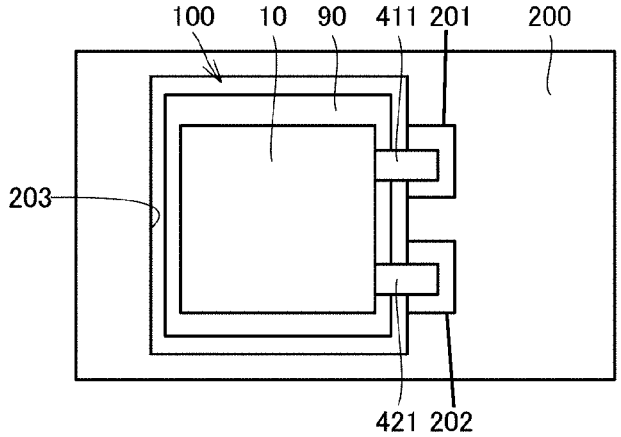
FIG. 8 is a plan view of the piezoelectric blower according to the first embodiment that is mounted on a circuit board.
Figure 9:
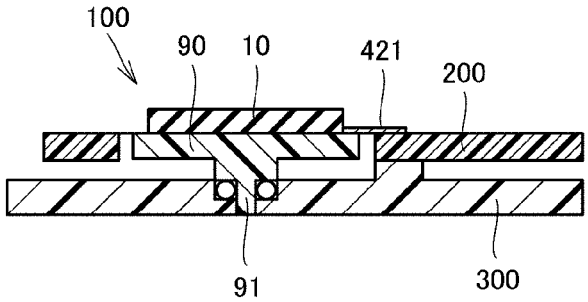
FIG. 9 is a sectional view of the piezoelectric blower according to the first embodiment that is mounted on the circuit board.

FIG. 8 is a plan view of the piezoelectric blower according to the first embodiment that is mounted on a circuit board. FIG. 9 is a sectional view of the piezoelectric blower according to the first embodiment that is mounted on the circuit board. Referring to FIGS. 8 and 9, how the piezoelectric blower 100 according to the first embodiment is mounted will now be described.

As illustrated in FIGS. 8 and 9, the piezoelectric blower 100 is mounted on, for example, a circuit board 200 supported by a supporting member 300. The circuit board 200 has a fitting hole 203 into which the piezoelectric blower 100 is to be fitted, and lands 201 and 202 to which the first outer terminal part 411 and the second outer terminal part 421 are to be connected, respectively. The lands 201 and 202 are provided on a major surface of the circuit board 200 that is on a side farther from the supporting member 300.

The piezoelectric blower 100 is attached to the supporting member 300 by fitting the nozzle portion 91 oriented to face toward the supporting member 300 into the fitting hole 203. In this state, the first outer terminal part 411 and the second outer terminal part 421 face the lands 201 and 202, respectively.

In the piezoelectric blower 100, the first conductive member 41 and the second conductive member 42 are both held by the holding portion 43. Therefore, the level difference between the first conductive member 41 and the second conductive member 42 can be reduced. Accordingly, the level difference between the first outer terminal part 411 included in the first conductive member 41 and the second outer terminal part 421 included in the second conductive member 42 can be reduced. Hence, the first outer terminal part 411 and the second outer terminal part 421 can be soldered to the lands 201 and 202, respectively.

To summarize, in the piezoelectric blower 100 according to the first embodiment, the holding portion 43 holds both of the following: the first conductive member 41 including the first connecting terminal part 412 to be connected to the second surface 32*a* of the piezoelectric device 32, the first conductive member 41 further including the first outer terminal part 411; and the second conductive member 42 including the exposed parts 422*a* to be electrically connected to the first surface 32*b* of the piezoelectric device 32 through the conduction paths provided in the vibrating plate 31 and leading to the piezoelectric device 32, the second conductive member 42 further including the second outer terminal part 421. Therefore, while a voltage is applied to the piezoelectric device 32, the level difference between the first outer terminal part 411 and the second outer terminal part 421 can be reduced. Hence, as described above, the piezoelectric blower 100 can be easily mounted on the circuit board 200 or the like. Furthermore, the first outer terminal part 411 and the second outer terminal part 421 are connected to the circuit board with solder instead of lead wires. Such a configuration prevents the generation of noise due to vibration of the lead wires that may occur with the vibration of the piezoelectric device 32 that expands and contracts.

Furthermore, if the first outer terminal part 411 and the second outer terminal part 421 are provided in one plane, the connection of the first outer terminal part 411 and the second outer terminal part 421 can be made more easily.

Second Embodiment

Figure 10:
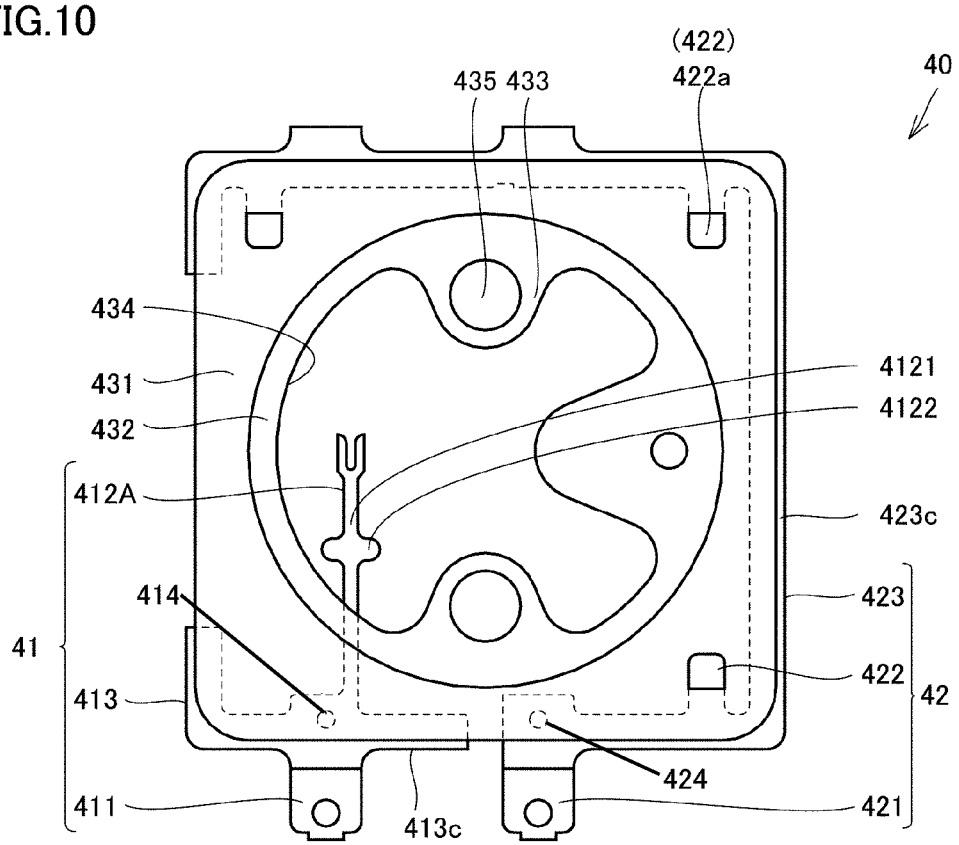
FIG. 10 is a plan view of a power-feeding plate included in a piezoelectric blower according to a second embodiment, seen from a side nearer to a vibrating plate.

FIG. 10 is a plan view of a power-feeding plate included in a piezoelectric blower according to a second embodiment, seen from a side nearer to a vibrating plate. Referring to FIG. 10, the piezoelectric blower according to the second embodiment will now be described.

As illustrated in FIG. 10, the piezoelectric blower according to the second embodiment differs from the piezoelectric blower 100 according to the first embodiment in the shape of a first connecting terminal part 412A included in the power-feeding plate 40. The other features are substantially the same.

The first connecting terminal part 412A includes a linear part 4121 and a projecting part 4122. The inner peripheral surface of the holding portion 43 defines the opening 434 of the holding portion 43. The linear part 4121 linearly extends from the inner peripheral surface of the holding portion 43 into the opening 434. The projecting part 4122 projects in a direction intersecting the direction in which the linear part 4121 extends. The projecting part 4122 is provided between the distal end and the proximal end of the linear part 4121.

Unlike a case where the connecting terminal part includes only the linear part 4121, the projecting part 4122 serves as a weight. With the projecting part 4122, the vibration occurring at a distal portion of the first connecting terminal part 412A with the displacement of the piezoelectric device 32 can be reduced. The vibration is transmitted to a proximal portion of the first connecting terminal part 412A. Consequently, the load to be applied to the proximal portion of the first connecting terminal part 412A can be reduced, and the breakage at the proximal portion of the first connecting terminal part 412A can be suppressed.

With such a configuration as well, the piezoelectric blower according to the second embodiment produces substantially the same advantageous effects as the piezoelectric blower according to the first embodiment.

Third Embodiment

Figure 11:
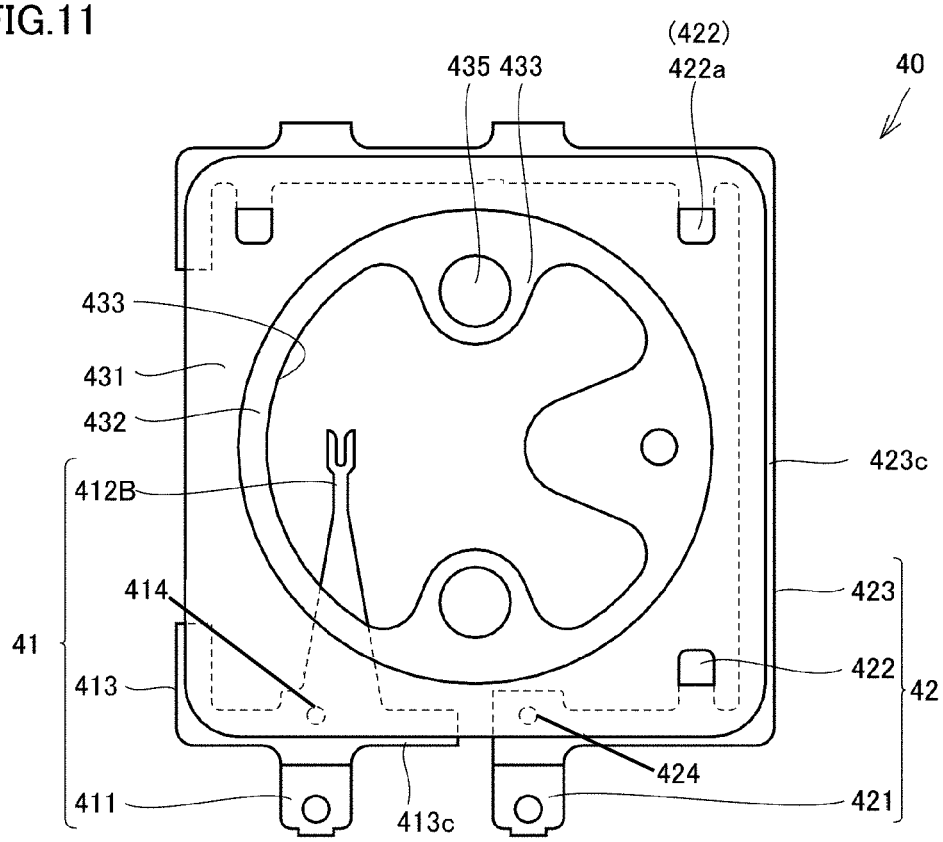
FIG. 11 is a plan view of a power-feeding plate included in a piezoelectric blower according to a third embodiment, seen from a side nearer to a vibrating plate.

FIG. 11 is a plan view of a power-feeding plate included in a piezoelectric blower according to a third embodiment, seen from a side nearer to a vibrating plate. Referring to FIG. 11, the piezoelectric blower according to the third embodiment will now be described.

As illustrated in FIG. 11, the piezoelectric blower according to the third embodiment differs from the piezoelectric blower 100 according to the first embodiment in the shape of a first connecting terminal part 412B included in the power-feeding plate 40. The other features are substantially the same.

The first connecting terminal part 412B has a tapered shape that is tapered from a proximal portion toward the distal end. Thus, the rigidity at the proximal portion of the first connecting terminal part 412B can be increased. In such a configuration, the vibration occurring at a distal portion of the first connecting terminal part 412B with the displacement of the piezoelectric device 32 can be reduced. The vibration is transmitted to the proximal portion of the first connecting terminal part 412B can be reduced. Consequently, the load to be applied to the proximal portion of the first connecting terminal part 412B can be reduced, and the breakage at the proximal portion of the first connecting terminal part 412B can be suppressed.

With such a configuration as well, the piezoelectric blower according to the third embodiment produces substantially the same advantageous effects as the piezoelectric blower according to the first embodiment.

Other Modifications

While the first to third embodiments described above each concern a piezoelectric blower in which the exposed parts 422*a* of the second conductive member 42 are electrically connected to the first surface 32*b* of the piezoelectric device 32 through the vibrating plate 31, the piezoelectric blower is not limited thereto. As long as the exposed parts 422*a* are each connected to the first surface 32*b* of the piezoelectric device 32 through a conduction path provided in the vibrating plate 31 and leading to the piezoelectric device 32, the conduction path may be changed according to need. For example, the first surface 32*b* and the exposed parts 422*a* may be electrically connected to each other as follows: a first hole is provided in a region of the vibrating plate 31 that faces part of the first surface 32*b* of the piezoelectric device 32, second holes are provided in regions of the vibrating plate 31 that face the respective exposed parts 422*a*, and wiring parts are provided in such a manner as to extend through the first hole and the second holes.

While the first to third embodiments described above each concern a case where the present disclosure is applied to a piezoelectric blower that suctions and discharges gas, the present disclosure may alternatively be applied to a pump that suctions and discharges liquid, or a pump employing a driving element other than a piezoelectric device (needless to say, the pump is limited to a displacement pump utilizing bending vibration of a vibrating plate).

While the first to third embodiments described above each concern a case where a portion of the vibrating plate 31 to which the piezoelectric device 32 is bonded has a circular shape in plan view, the vibrating plate is not limited thereto. The vibrating plate may alternatively have a rectangular shape or a polygonal shape in plan view, as long as the vibrating plate is vibratable by the piezoelectric device 32.

Figure 12:
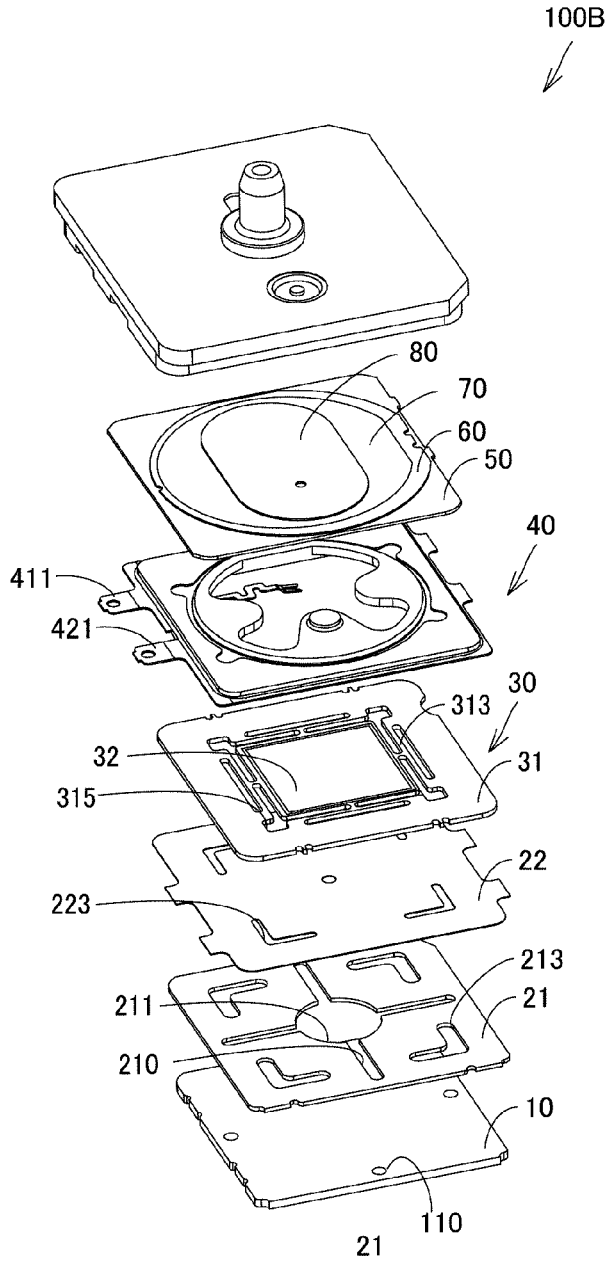
FIG. 12 is an exploded perspective view of a piezoelectric blower according to a modification.

FIG. 12 is an exploded perspective view of a piezoelectric blower according to a modification. As illustrated in FIG. 12, in a piezoelectric blower 100B according to the modification, a portion of the vibrating plate 31 to which the piezoelectric device 32 is bonded has a rectangular shape in plan view, as mentioned above. In such a case, the piezoelectric device 32 can also have a rectangular shape. In accordance with the shape of the portion to which the piezoelectric device 32 is bonded, the positions and/or shapes of the plurality of passage holes 210, the plurality of adhesive-confining holes 213 and 223, the hole portions 315, and the plurality of connecting portions 313 are to be changed appropriately. Specifically, the plurality of passage holes 210 are arranged to form a cross pattern. The plurality of adhesive-confining holes 213 and 223 are provided at the four corners of a rectangular area overlapping the portion to which the piezoelectric device 32 is bonded, in such a manner as to surround the area while being spaced apart therefrom. The adhesive-confining holes 213 and 223, each has an L shape. The plurality of connecting portions 313 are provided on the respective sides of the portion to which the piezoelectric device 32 is bonded.

While the first to third embodiments and the modification described above each concern a piezoelectric blower in which the cover plate 10, the first passage-defining member 21, and the second passage-defining member 22 are separate components, the piezoelectric blower is not limited thereto. The foregoing elements may be integrated into a unit.

The above embodiments of the present disclosure are only exemplary and are not restrictive in all aspects. The scope of the present disclosure is defined by the appended claims and includes all changes made thereto within the context and scope equivalent to the claims.

REFERENCE SIGNS LIST

1 pump housing
2 pump chamber
3 passage portion
10 cover plate
20 passage-defining portion
21, 22 passage-defining member
30 vibrating unit
31 vibrating plate
31*a* first major surface
32 piezoelectric device
32*a* second surface
32*b* first surface
40 power-feeding plate
41 first conductive member
42 second conductive member
43 holding portion
50 reinforcing plate
51 hole portion
60 second reinforcing plate
61 first hole portion
62 second hole portion
70 joining member
71 hole portion
80 diaphragm
81 hole portion
90 valve housing
91 nozzle portion
92 exhaust hole
100 piezoelectric blower

110 suction hole
200 circuit board
201, 202 land
203 fitting hole
210, 211 passage hole
213 adhesive-confining hole
220 passage hole
223 adhesive-confining hole
300 supporting member
311 disc portion
312 frame portion
313 connecting portion
315 hole portion
411 first outer terminal part
412, 412A, 412B first connecting terminal part
413 first coupling part
413*c* extruded part
414 through-hole
421 second outer terminal part
422 second connecting terminal part
422*a* exposed part
423 second coupling part
423*c* extruded part
424 through-hole
431 outer frame part
432 inner frame part
433 wave part
434 opening
435 displacement-regulating part
4121 linear part
4122 projecting part

The invention claimed is:

1. A pump comprising:

a pump housing having a pump chamber;

a vibrating plate having a first major surface and facing the pump chamber;

a piezoelectric device provided on the first major surface and vibrating the vibrating plate; and a power-feeding plate including a first metal conductor a part of which is exposed to an outside from the pump housing, and a second metal conductor electrically insulated from the first metal conductor, wherein the piezoelectric device has a first surface facing the first major surface; and a second surface positioned on a side farther from the first major surface, wherein the first metal conductor includes a first outer terminal part positioned outside the pump housing; a first connecting terminal part electrically connected to the second surface of the piezoelectric device; and a first coupling part coupling the first outer terminal part and the first connecting terminal part to each other, wherein the second metal conductor includes a second outer terminal part positioned outside the pump housing; and a second connecting terminal part electrically connected to the second outer terminal part and to the first surface of the piezoelectric device, wherein the second connecting terminal part contacts the first major surface of the vibrating plate without lead wires, and wherein the second outer terminal part does not abut the second connecting terminal part, and wherein the power-feed plate has an opening extending through the power-feed plate in a thickness direction such that the piezoelectric device is exposed through the opening.

2. The pump according to claim 1, wherein the power-feeding plate includes a holding portion holding both the first metal conductor and the second metal conductor.

3. The pump according to claim 2, wherein the second metal conductor includes a second coupling part coupling the second outer terminal part and the second connecting terminal part to each other, and wherein each of the first coupling part and the second coupling part includes a portion extending along an outer periphery of the holding portion.

4. The pump according to claim 3, wherein the portion of each of the first coupling part and the second coupling part that extends along the outer periphery of the holding portion includes an extruded part extruded outward from the holding portion.

5. The pump according to claim 3, wherein an inner surface of the holding portion defines the opening of the power-feed plate, and wherein the first connecting terminal part includes a meandering part meandering from the inner peripheral surface of the holding portion into the opening.

6. The pump according to claim 3, wherein the holding portion is a cured resin member comprising cured resin, wherein each of the first coupling part and the second coupling part has a through-hole in a region overlapping the holding portion in plan view, and wherein the cured resin member is provided over front and back surfaces of the region overlapping the holding portion and fills the through-hole.

7. The pump according to claim 1, wherein the second metal conductor includes an exposed part and is electrically continuous with the first major surface of the vibrating plate by being in contact with the first major surface.

8. The pump according to claim 7, wherein the power-feeding plate includes a holding portion holding both the first metal conductor and the second metal conductor, and wherein the exposed part is surrounded by the holding portion in plan view.

9. The pump according to claim 7, wherein the exposed part is one of a plurality of exposed parts.

10. The pump according to claim 1, wherein the first outer terminal part and the second outer terminal part are provided in one plane.

11. The pump according to claim 1, further comprising a reinforcing plate provided on the power-feeding plate on a side farther from the vibrating plate.

12. The pump according to claim 1, further comprising:

a reinforcing plate provided on the power-feeding plate on a side farther from the vibrating plate, wherein the power-feeding plate includes a holding portion holding both the first metal conductor and the second metal conductor wherein a difference $d_1$ between a coefficient of linear expansion $\alpha_r$ of the reinforcing plate and a coefficient of linear expansion $\alpha_h$ of the holding portion is in a range of 20% to 500% of a difference $d_2$ between a coefficient of linear expansion $\alpha_v$ of the vibrating plate and the coefficient of linear expansion $\alpha_h$ of the holding portion, such that $d_1$ is in a range of $0.20*d_2$ to $5*d_2$.

13. The pump according to claim 4, wherein an inner surface of the holding portion defines the opening of the power-feed plate, and wherein the first connecting terminal part includes a meandering part meandering from the inner peripheral surface of the holding portion into the opening.

14. The pump according to claim 4, wherein the holding portion is a cured resin member comprising cured resin, wherein each of the first coupling part and the second coupling part has a through-hole in a region overlapping the holding portion in plan view, and wherein the cured resin member is provided over front and back surfaces of the region overlapping the holding portion and fills the through-hole.

15. The pump according to claim 5, wherein the holding portion is a cured resin member comprising cured resin, wherein each of the first coupling part and the second coupling part has a through-hole in a region overlapping the holding portion in plan view, and wherein the cured resin member is provided over front and back surfaces of the region overlapping the holding portion and fills the through-hole.

16. The pump according to claim 8, wherein the exposed part is one of a plurality of exposed parts.

17. The pump according to claim 2, wherein the first outer terminal part and the second outer terminal part are provided in one plane.

18. The pump according to claim 3, wherein the first outer terminal part and the second outer terminal part are provided in one plane.

19. The pump according to claim 4, wherein the first outer terminal part and the second outer terminal part are provided in one plane.

20. The pump according to claim 5, wherein the first outer terminal part and the second outer terminal part are provided in one plane.

* * * * *